US005713551A

United States Patent [19]

Doerner

[11] Patent Number: 5,713,551

[45] Date of Patent: Feb. 3, 1998

[54] DEVICE FOR SUPPORTING OF FILE WRAPPERS

[76] Inventor: Ulf Doerner, Simmernstrasse 13, Munchen 40, Germany, D-8000

[21] Appl. No.: 645,237

[22] Filed: May 13, 1996

Related U.S. Application Data

[63] Continuation-in-part of Ser. No. 146,070, Nov. 8, 1993, abandoned.

[30] Foreign Application Priority Data

Apr. 16, 1992 [DE] Germany ..... 9205324 U
Apr. 16, 1993 [WO] WIPO ..... PCT/EP93/00934

[51] Int. Cl.[6] ..... B43L 7/00; B42F 13/36; A47G 1/24

[52] U.S. Cl. ..... 248/441.1; 33/485; 402/80 L; 402/4; 281/33; 281/51

[58] Field of Search ..... 281/33, 42, 45, 281/51, 28; 402/4, 71, 80 R, 80 L, 80 P; 248/441.1, 459, 460, 456, 454, 461; 33/484, 485, 490

[56] References Cited

U.S. PATENT DOCUMENTS

| | | | |
|---|---|---|---|
| 555,249 | 2/1896 | Koller | 248/454 |
| 708,203 | 9/1902 | Chandler | 248/454 X |
| 738,763 | 9/1903 | Boden | 281/33 X |
| 839,643 | 12/1906 | Richardson | 248/456 |
| 1,086,906 | 2/1914 | Felten | 248/456 |
| 1,467,534 | 9/1923 | Crook, Jr. | 33/485 |
| 2,005,474 | 6/1935 | Schade | 402/4 |
| 2,532,487 | 12/1950 | Faulkner | 248/441.1 X |
| 2,687,313 | 8/1954 | Pisano | 281/42 |
| 2,792,668 | 5/1957 | Gallamos | 248/456 |
| 4,623,276 | 11/1986 | Kinneir | 281/33 X |
| 4,852,909 | 8/1989 | Stoyanoff | 248/447 X |
| 5,044,807 | 9/1991 | Meservy et al. | 248/454 X |
| 5,230,535 | 7/1993 | Figlenski | 248/441.1 X |
| 5,379,979 | 1/1995 | Due | 281/45 X |

FOREIGN PATENT DOCUMENTS

| | | | |
|---|---|---|---|
| 5957 | 12/1979 | European Pat. Off. | 248/460 |
| 387959 | 1/1924 | Germany | 402/80 R |
| 1214197 | 4/1966 | Germany | 402/80 R |
| 2116481 | 9/1983 | United Kingdom | 402/80 R |

*Primary Examiner*—Robert W. Gibson, Jr.
*Assistant Examiner*—Stephen S. Wentsler
*Attorney, Agent, or Firm*—George W. Dishong

[57] ABSTRACT

A holding rail is useful with a storage file having stiff cover sides and an upright clip holding presentation pages. The rail may be used to hold the storage file in a presentation position or to hold the presentation pages contained in the file in a clamped-down position. The rail is also useful for linear measurement. The holding rail is substantially flat with a plurality of upwardly bent legs. At least one upwardly bent leg is located at opposing end portions of the rail. The storage file may be held in a presentation position by placing the edge of each of the stiff cover sides into one of the upwardly bent legs of the rail. The rail thereby supports the storage file with the upright clips racing outwardly and the presentation pages in the presentation position. A plurality of tapered slots or other perforations are formed within the rail. The tapered slots may engage the upright clip, thereby holding the presentation pages of the storage file in a clamped-down position. At least one of the edges of the rail has divisions such that the rail is useful for linear measurement.

10 Claims, 3 Drawing Sheets

DEVICE FOR SUPPORTING OF FILE WRAPPERS

This is continuation-in-part of application Ser. No. 08/146,070 filed Nov. 8, 1993 and now abandoned.

BACKGROUND OF THE INVENTION

1. Field of the Invention

The invention relates to a device for holding storage files, especially presentation files, in presentation position.

2. Description of the Prior Art

Storage files of a wide variety of manufacturers are sold in their millions every year, a large part of which are used as so-called "presentation files" on training courses, as service files or the like. The presentation files for training courses are also referred to as flip-chart files. The files comprise two stiff cover sides or baseplates and a spine connecting them and generally have, on the one inner side, two or four upright clips which can be opened and closed and into which the individual presentation sheets, transparencies or, indeed, structures made from stiff card or plastic can be hung. These clips are also referred to as a ring mechanism. The securement of the file contents is usually effected, in storage files of this kind, by means of so-called "tip clamps", comprising rocker, springs and tip clamp rail. It must be understood by any ordinarily skilled person that most forms of such clamps/tip clamps have what may be called a tip clamp rail. This typically takes the form of a relatively stiff, substantially flat member and has dimensions where the length is commensurate with the storage file dimension height (whether it be height or width depends upon where clamping of the material takes place-on the side or at the top) and the width or other dimension being substantially less than the length. By virtue of holding eyelets on the base plate, the clips are usually secured (catch-lock) once the file is closed.

In order to be able to stand up such a file in an opened-up fashion, for the demonstration of its contents for example, constructions of enormous complexity are already know, for example, a part of the one cover card (baseplate) being partially folded down.

SUMMARY OF THE INVENTION

The object of the invention is to bring about a presentation using substantially simpler means.

This is achieved surprisingly simply by the fact that, in a device for holding storage files, especially presentation files, in presentation position, a flat holding rail is provided having upwardly bent or folded-over legs at each end.

This extremely simple construction enables the file, for example, to be opened by 240° and stood simply on the rail. The two cover flap parts of the file are held secure, by the two legs, against the file being opened into the flat state.

In a refinement of the invention, it is possible to provide, at something of a reduced spacing, two additional, upright elements on the rail, so that the file is able to stand stably in another position. The amount of the reduced spacing will clearly and obviously be a function of the dimensions of the storage file. It is also obvious that it is not necessary to have two additional upright elements where one is at each end of the rail inside, obviously, the upwardly bent or folded over legs at the one end and the other end of the rail. Additional upright elements need only be added to one or the other end of the rail spaced by a predetermined distance from the upwardly bent or folded-over legs at each end of the rail.

As material for the holding rail, any stable material such as steel, non-ferrous metals, wood, plastic, but also, for example, a holding rail made of recycled paper, having stuck-on recycled paper cubes at the ends, can be used.

The rail carries perforations, for example four perforations (different depositing grids) and can then be inserted, in exactly the same way as the charts, into the retaining clips.

The holding rail can exhibit longitudinally running beads for stabilization purposes.

In a refinement of the invention, it is possible to configure the holding rail such that it is integrated as a single piece with the tip clamp of the storage file, in which case the legs are bent up further correspondingly. That is to say that the holding rail may replace the tip clamp rail, generally a part of the known types of so-called tip clamps, and also function as the tip clamp rail of the so-called tip clamp. Thus, there is shown perforations positioned so as to fit onto well known tip clamps.

It is therefore an object of the present invention to provide a substantially flat holding rail for holding a storage file in a position for presentation of information contained on a plurality of presentation sheets which sheets are contained within the storage file, i.e., binder. The storage file has two substantially stiff cover sides, a spine connecting each of the stiff cover sides each to the other along one edge of each of the stiff cover sides. There are also at least two upright clips located on an inner side of one of the stiff cover sides and the spine, each of the upright clips openable and closable permitting thereby insertion and holding of the presentation sheets. The substantially flat holding rail has a substantially rectangular geometry with a predetermined length and width dimension wherein the length is determined by the storage file dimension and the length is at least four times the width dimension. The substantially flat holding rail additionally has one end and an other end. The one end and the other end separated by the length dimension. The holding rail further has a first edge and a second edge the first and second edge separated by the width dimension. Further there are at least two upwardly bent legs, one of the legs at the one end and an other of the legs at the other end of the holding rail. Perforations, at least one of which may be in the form of tapered slots are positioned between the first and second edges of the rail to align with each of the upright clips. The perforations are for affixing the holding rail within the storage file and to the upright clips (sometimes known as tip-clamps). The holding rail may be made of any appropriate material such as plastic, steel, other forms of ferrous metal, non-ferrous metal, wood, paper, and composition alloys. A preferred material is galvanized St 37 steel.

It is a further object of the invention to provide the substantially flat holding rail as described above further comprising divisions positioned along at least one of the edges.

It is a still further object of the invention to provide the substantially flat holding rail as above, wherein the tapered slot has a predetermined length and a maximum width dimension. The maximum width permits affixing to the two upright clips. A minimum width dimension and the slot width gradually decreases from the maximum to the minimum width dimension. The tapered slot provides clamping of the presentation sheets when the substantially flat holding rail is affixed to the upright clips and is forcibly moved such that the upright clip is forced into the tapered slot.

A primary object of the invention is to provide an improved device for holding storage files in a clamped-down position within the device, and for holding the storage files in a presentation position. The storage files then being called presentation files. The device has the stiff cover sides, the spine the upright clips or tip-clamps as above described the upright clips being openable and closable permitting thereby insertion and retention of the storage files. The improvement comprising the flat holding rail, the flat holding rail having rail edges and having a plurality of upwardly bent legs at least one upwardly bent leg at opposing end portions of the flat holding rail. The flat holding rail serves to hold the device in the presentation position when the edges opposed to the one edge of each stiff cover side is positioned such that one is within one of the upwardly bent legs and the other edge of the other cover side is within another of the upwardly bent legs. The device is supported thereby with the upright clips outwardly facing and the presentation files in the presentation position. Perforations may be disposed in the holding rail for affixing the holding rail onto the two or more upright clips and within the device for holding storage files. The perforations may be tapered slots having a predetermined length and a maximum width dimension such maximum width permitting affixing to the upright clips and a minimum width dimension. The slot width gradually decreases from the maximum to the minimum width dimension. Such tapered slot or slots provide for the holding of the storage files in a clamped-down position within the device when the holding rail is affixed to the upright clips and forcibly moved such that the upright clip is forced into the tapered slot.

A further primary object of the invention is to provide the improved device for holding storage files wherein divisions may be positioned along at least one of said rail edges. The divisions would be similar to those divisions on a ruler used for linear measurement.

A still further primary object of the invention is to provide the improved device for holding storage files wherein longitudinally running beads are disposed on an upper surface of the holding rail. The longitudinally running beads providing stabilization and strength for the holding rail.

A still further primary object of the invention is to provide the improved device for holding storage files wherein the holding rail is made of material selected from the group consisting of plastic, ferrous metal, non-ferrous metal, wood, paper, and composition alloys. The holding rail is preferably formed of galvanized St 37 steel.

BRIEF DESCRIPTION OF THE DRAWINGS

An illustrative embodiment of the invention will now be explained in greater detail with reference to the appended drawing, in which.

DESCRIPTION OF THE PREFERRED EMBODIMENT

Figure 1A:
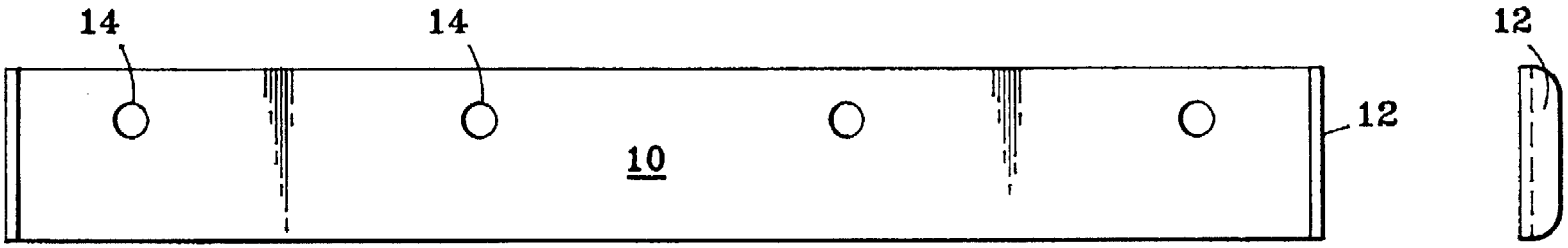
FIG. 1A shows the holding rail in top view and in the associated frontal top view, FIG. 1B in projection.
Figure 1C:
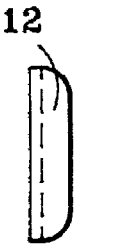
FIG. 1C is an end view of the rail.
Figure 1B:
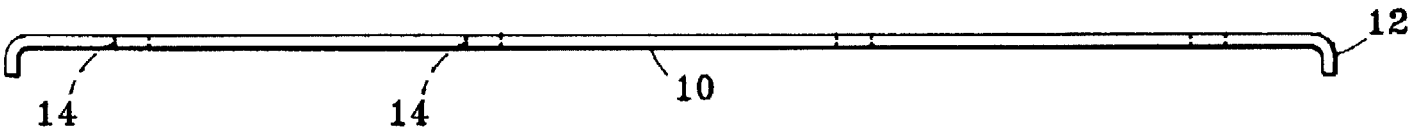
Figure 2:
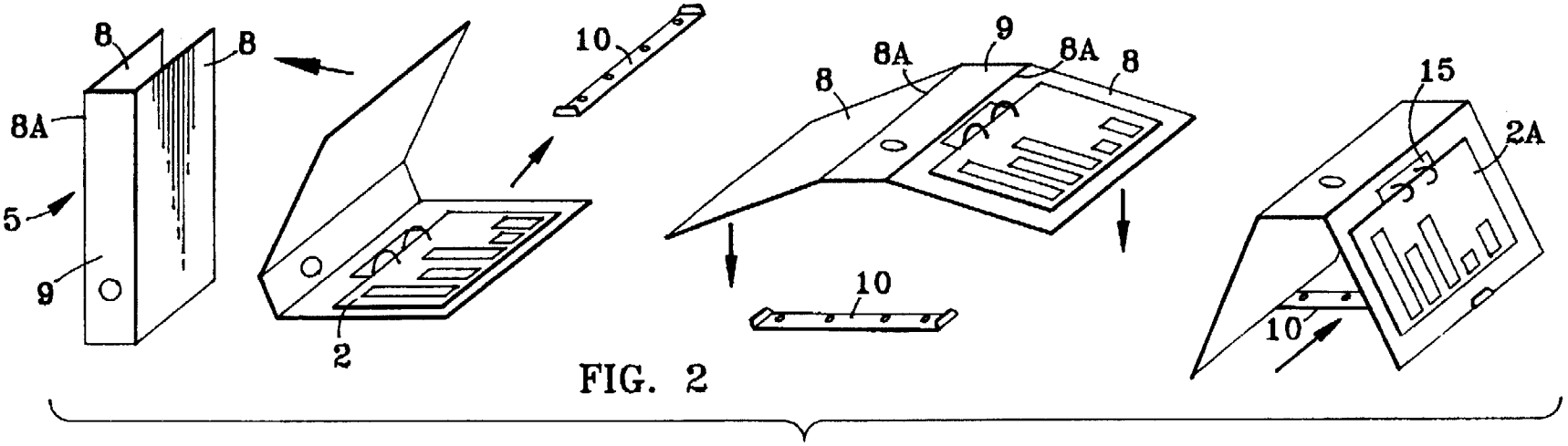
FIG. 2 illustrates the use of the holding rail, wherein it is shown how the storage file is brought into its stable holding or presentation position by virtue of the holding rail 10, FIGS. 3A, 3B and 3C collectively provide an alternative illustration of the use of the device and depicts an obvious representation of measuring divisions and tapered slotted perforations.
Figure 3A:
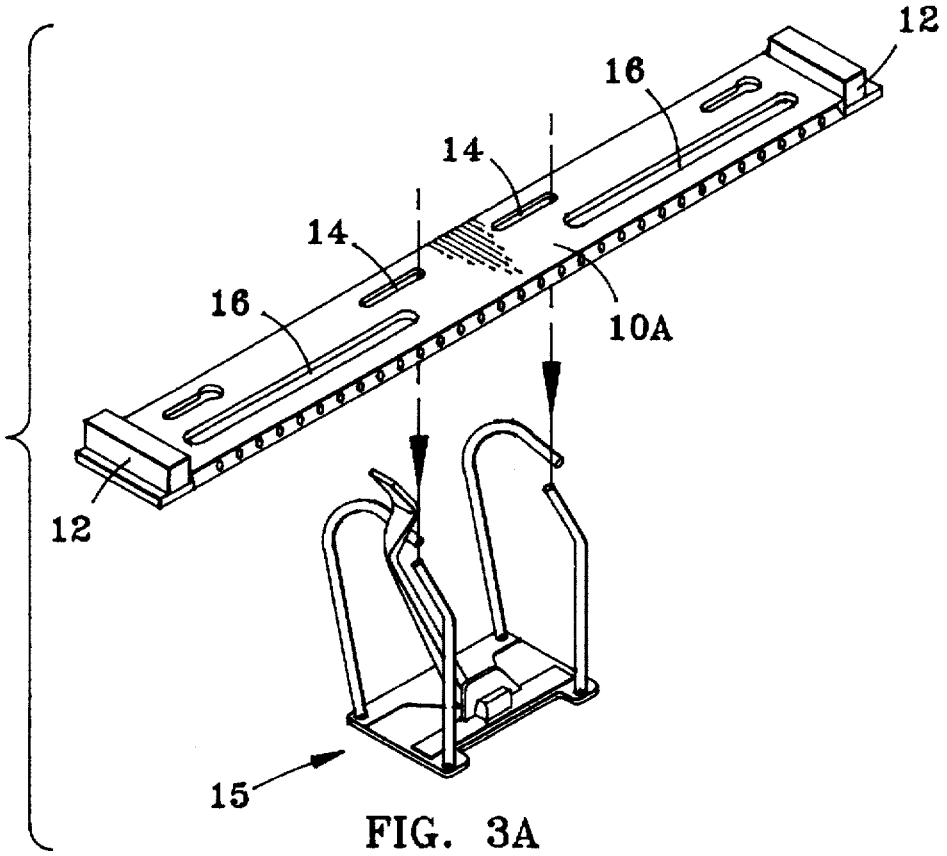
Figure 3B:
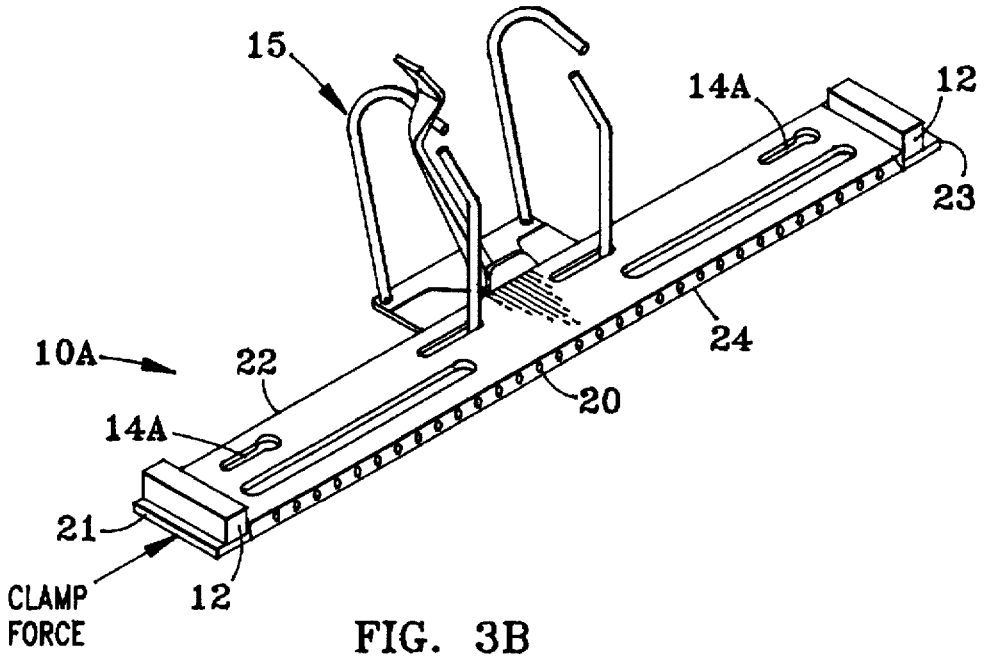
Figure 3C:
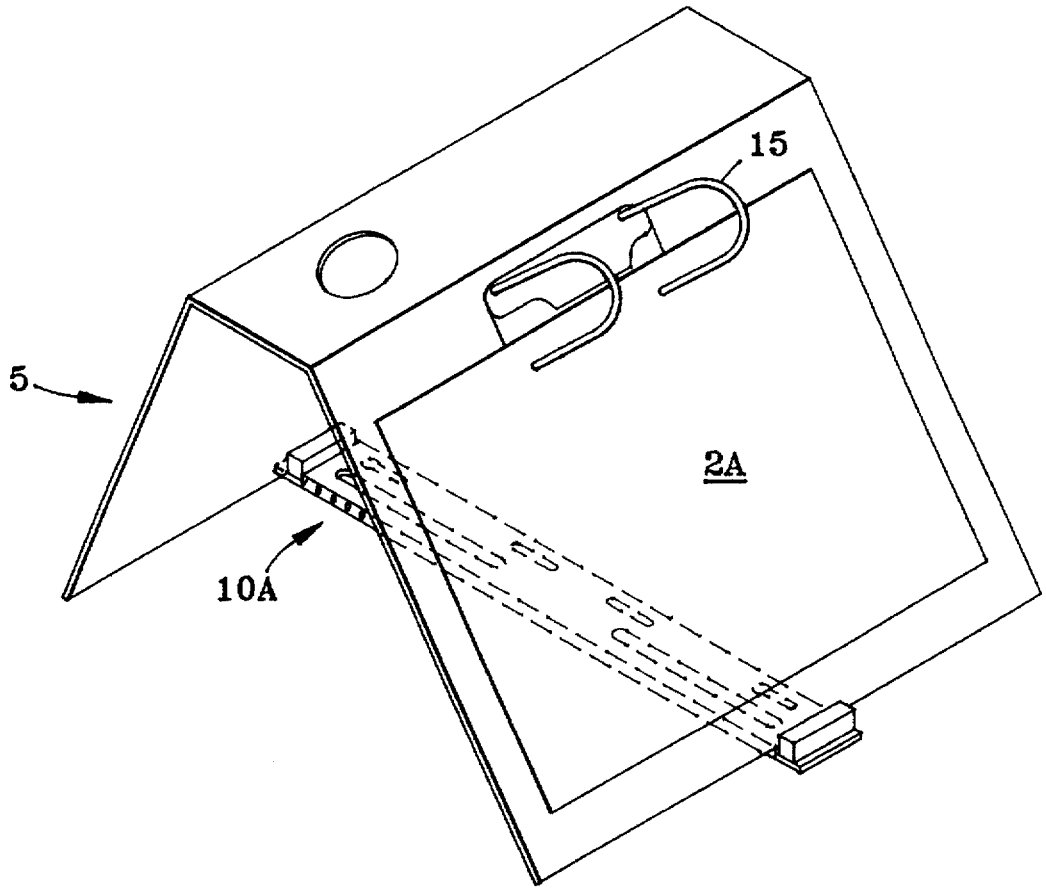
Figure 4:
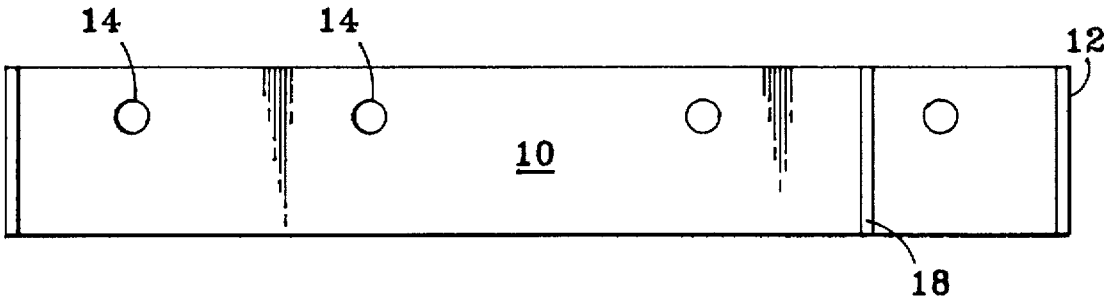
FIG. 4 illustrates an additional upright element added to one end of the rail and spaced by a predetermined distance from the upwardly bent or folded-over legs at one end of the rail.

In the most simple embodiment of the invention, rail 10 being made from, for example, galvanized St 37 steel, has an upwardly bent leg 12 at each end. Perforations 14 sized to fit onto the upright clip 15. Rail 10 may be stored within the improved binder device 5, (i.e., the improved device 5 for holding storage files in a clamped-down position within said device, and for holding storage files 2 in a presentation position, the storage files 2 then being called presentation files 2A). Improved device 5 has two substantially stiff cover sides 8, a spine 9 connecting each stiff cover side each to the other along one edge 8A of each stiff cover sides 8. An upright clip 15 has two posts onto which perforations 14 fit. Rail 10, when removed, is used to support improved device 5 in the presentation position.

Rail 10 and/or rail 10A, rail 10A having enhancements such as tapered slots 14A divisions 20 (such divisions 20 would necessarily lie along either first edge 22 or second edge 24 or both edges of the long edges of the holding rail 10A, function to hold device/binder in presentation position. However rail 10A and may be useful as a straight edge, as a ruler for linear measurements and as a clamp-down onto storage files 2 being stored in binder 5. Two sets of holes 14, may be located to match to different upright clips 15, i.e., tip-clamps 15. At the ends, rail 10, is bent up by a small amount to form end-side legs, i.e., upwardly bent legs 12 at least one upwardly bent leg at opposing end portions of the flat holding rail 10. In an alternate embodiment, the device may be formed of recycled paper, including recycled paper cubes stuck onto a recycled paper rail.

The rail can be produced, for example, from galvanized St 37, by metal strips being cut off every 30 cm, deburred and the holes then punched and the ends bent up. The bending-up can be realized by 90°, but a bending-up by an angle of between 60° and 90° to the rail is also possible. The height of the bent-up legs can range from 1 to 10 mm. The holding rail 10A being also useful as a "tip clamp rail" and a means for holding presentation materials 2A within improved device 5 where such means comprises elongated perforations wherein at least one elongated perforation is tapered and sized to fit onto the posts of the "binder" clips and upon sliding of the holding/tip clamp rail 10A, i.e., rail 10A, the rail binds and consequently holds down the materials within the "binder".

Rail 10 may also include almost any number of additional upwardly bent legs 18. Since upwardly bent/folded-over legs 12 are located one at one end 21 and the other leg 12 at the other end 23 of rail 10A, clearly additional upright elements 18 would be located on rail 10A at a predetermined distance in from either one or both of legs 12. These additional upright elements 18 would allow the storage file or binder book to be held in a position having increased angle.

Divisions 20 may be incorporated along at least one longer edge first edge 22 or second edge 24 of rail 10A simply as a convenience for the user. Where stabilization or stiffening is desirable, longitudinally running beads 16 may be placed in an obvious manner so as to provide rail 10A with more rigidity/stiffness. It would make no difference whether the bead is on the "top" or on the "bottom" of rail 10A except where rail 10 or 10A is additionally intended for use in drawing straight lines using one of edges 22 or 24.

It should also be noted that rail 10A illustrates a manner for effecting a way to make rail 10A serve not only as a means for holding device 5 in a presentation position but also as a tip clamp rail replacing the tip clamp rail usually found as a component of well known clamps. Providing perforations 14 as tapered slots 14A permits the clamp-down of the files. When rail 10A is placed onto the posts of tip-clamp 15 and then moved perpendicularly relative to the posts, tapered slots 14A of rail 10A are caused to wedge and tighten onto the posts providing the desired clamp-down action. I.e., the presentation materials placed on the posts are held down by rail 10A when slots 14A are caused to wedge onto the vertical posts of upright clip 15.

Rail 10 and 10A can be punched. Rail 10 may also include longitudinally running beads 16 for stabilization purposes, and two additional upright elements 18 on rail 10.

I claim:

1. A substantially flat holding rail for holding a storage file in a position for presentation of information contained on a plurality of presentation sheets contained within said storage file, said storage file having two substantially stiff cover sides, a spine connecting each said stiff cover side each to the other along one edge of each said stiff cover side, at least two upright clips located on an inner side of one of said stiff cover sides and said spine, each of said upright clips openable and closable permitting thereby insertion and holding of said presentation sheets, said substantially flat holding rail comprising:

a substantially rectangular geometry with a predetermined length dimension and a predetermined width dimension wherein said length dimension is determined by said storage file dimension and wherein said length dimension is at least four times said width dimension, wherein said substantially flat rail has a one end and an other end, said one end and said other end separated by said length dimension, wherein said substantially flat rail has a first rail edge and a second rail edge, said first rail edge and said second rail edge separated by said width dimension;

at least two upwardly bent legs, one of said at least two upwardly bent legs at said one end and an other of said at least two upwardly bent legs at said other end of said substantially flat rail;

perforations positioned between said first rail edge and said second rail edge of said substantially flat rail to align with each said at least two upright clips, said perforations for affixing said substantially flat holding rail within said storage file and to said at least two upright clips; and divisions positioned along at least one of said first rail edge and said second rail edge such that said substantially flat holding rail is usable as a measuring device.

2. The substantially flat holding rail according to claim 1, wherein said substantially flat rail is made of material selected from the group consisting of plastic, ferrous metal, non-ferrous metal, wood, paper, and composition alloys.

3. The substantially flat holding rail according to claim 2, wherein at least one of said perforations is a tapered slot, said tapered slot having a predetermined length and a predetermined slot width having a maximum width dimension such maximum width permitting affixing to said at least two upright clips and a minimum width dimension wherein said slot width gradually decreases from said maximum to said minimum width dimension, said tapered slot providing clamping of said presentation sheets when said substantially flat holding rail is affixed to said upright clips and is forcibly moved such that one of said at least two upright clips is forced into said tapered slot.

4. In an improved device for holding storage files in a clamped-down position within said device, and for holding said storage files in a presentation position, whereby said storage files being presentation files, said device having two substantially stiff cover sides, each said substantially stiff cover side having an edge and an opposing edge, a spine connecting each said stiff cover side each to the other along one edge of each said stiff cover sides, at least two upright clips located on an inner side of one of said stiff cover sides and said spine, each of said upright clips openable and closable permitting thereby insertion and retention of said storage files, said improvement comprising:

a flat holding rail, said flat holding rail having rail edges and having a plurality of upwardly bent legs at least one upwardly bent leg at opposing end portions of said flat holding rail, said flat holding rail supporting said device with said upright clips outwardly facing and said presentation files in said presentation position when said opposing edge of each said stiff cover side is positioned each within one of said upwardly bent legs;

perforations disposed in said holding rail for affixing said flat holding rail onto said at least two upright clips and within said device for holding the storage files; and divisions positioned along said rail edges such that said substantially flat holding rail is usable as a measuring device.

5. The improved device according to claim 4, wherein said perforations are tapered slots having a predetermined length, a predetermined slot width having a maximum width dimension such maximum width permitting affixing to said at least two upright clips and a minimum width dimension wherein said slot width gradually decreases from said maximum to said minimum width dimension, said tapered slots providing said holding of said storage files in a clamped-down position within said device when said substantially flat holding rail is affixed to said upright clips and is forcibly moved such that one of said at least two upright clips is forced into one of said tapered slots.

6. The improved device according to claim 5, further comprising longitudinally running beads disposed on an upper surface of said holding rail said longitudinally running beads providing stabilization of said holding rail.

7. The improved device according to claim 5, wherein said holding rail is made of material selected from the group consisting of plastic, ferrous metal, non-ferrous metal, wood, paper, and composition alloys.

8. The device according to claim 5, wherein said holding rail is formed of galvanized St 37 steel.

9. The improved device according to claim 4, further comprising longitudinally running beads disposed on an upper surface of said holding rail said longitudinally running beads providing stabilization of said holding rail.

10. The improved device according to claim 4, wherein said holding rail is made of material selected from the group consisting of plastic, ferrous metal, non-ferrous metal, ,wood, paper, and composition alloys.

* * * * *